US007878441B2

(12) United States Patent
Wohlfahrt et al.

(10) Patent No.: US 7,878,441 B2
(45) Date of Patent: Feb. 1, 2011

(54) ELEMENT FOR TRANSFERRING A MOVING WEB ONTO A CORE, AND METHOD FOR IT'S USE

(75) Inventors: Matthias Wohlfahrt, Heidenheim (DE); Zygmunt Madrzak, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 856 days.

(21) Appl. No.: 11/366,455

(22) Filed: Mar. 3, 2006

(65) Prior Publication Data

US 2006/0144989 A1 Jul. 6, 2006

Related U.S. Application Data

(60) Division of application No. 10/919,341, filed on Aug. 17, 2004, which is a continuation of application No. PCT/EP03/01411, filed on Feb. 13, 2003.

(30) Foreign Application Priority Data

Feb. 18, 2002 (DE) ..... 102 06 576

(51) Int. Cl.
*B65H 35/08* (2006.01)

(52) U.S. Cl. ..... 242/526.3; 242/526.2; 242/532.3

(58) Field of Classification Search ..... 242/526.2, 242/521, 532, 532.3, 526.3, 583
See application file for complete search history.

(56) References Cited

U.S. PATENT DOCUMENTS 3,599,888 A * 8/1971 Coudriet et al. ..... 242/526.2
4,414,258 A 11/1983 Corbin et al.
4,445,646 A 5/1984 Karr et al.
4,659,029 A * 4/1987 Rodriguez ..... 242/526.2
5,453,141 A 9/1995 Rodriguez et al.
5,637,170 A 6/1997 Rodriguez et al.
5,810,279 A 9/1998 Rodriguez et al.
5,916,651 A * 6/1999 Wienberg et al. ..... 428/40.1
6,076,761 A 6/2000 Bartelmuss et al.
6,129,305 A 10/2000 Moller et al.
6,929,212 B2 8/2005 Madrzak et al.

FOREIGN PATENT DOCUMENTS

DE 3515519 10/1986
DE 1 0161073 6/2003

(Continued)

*Primary Examiner*—William E Dondero
(74) *Attorney, Agent, or Firm*—Greenblum & Bernstein, P.L.C.

(57) ABSTRACT

The invention relates to an element for forming a leading end of a web from a running material web, especially a paper or board web, having a certain width (B). The invention comprises an element which has a smaller width ($B_M$) that the width (B) of the material web, and in that the element is embodied in such a way that a new leading end of a web is formed at the latest after said element as been introduced into a nip formed by a winding cylinder and the winding core, and is partially covered by the material web. The invention also relates to a method for forming a leading end of a web from a running web material web, especially a paper or board web, applied to a winding core, whereby at least one element is used according to the invention.

37 Claims, 4 Drawing Sheets

FOREIGN PATENT DOCUMENTS

| | | |
|---|---|---|
| DE | 1 0163554 | 7/2003 |
| DE | 1 0201410 | 8/2003 |
| EP | 0543788 | 5/1993 |
| EP | 0912435 | 3/2003 |
| WO | 98/52858 | 11/1998 |

* cited by examiner

Fig. 4(a)
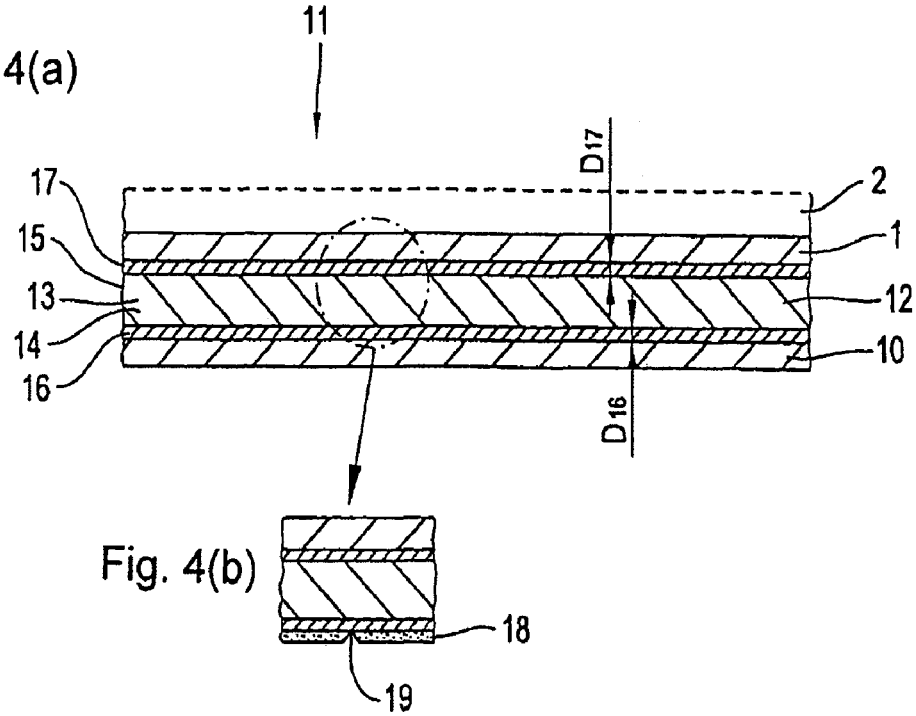
Fig. 4(b)
Fig.5
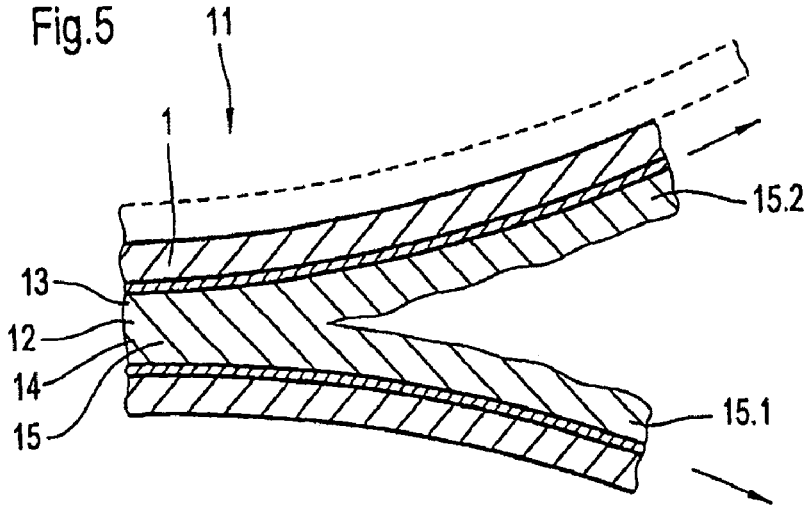

ELEMENT FOR TRANSFERRING A MOVING WEB ONTO A CORE, AND METHOD FOR IT'S USE

CROSS-REFERENCE TO RELATED APPLICATIONS

The present application is a divisional application of copending U.S. application Ser. No. 10/919,341, filed Aug. 17, 2004, which is a continuation of International Application No. PCT/EP03/01411, filed Feb. 13, 2003, which claims priority under 35 U.S.C. §119 of German Patent Application No. 102 06 576.4, filed Feb. 18, 2002, the disclosures of each of which are expressly incorporated by reference herein in their entirety.

BACKGROUND OF THE INVENTION

1. Field of the Invention

The invention relates to an element and method for forming a leading end of a web from a moving web, in particular a paper or board web, having a certain width.

A method of forming a leading end of a web from a moving web and transferring the same is used, for example, in the area of a reel-up of a machine for producing paper or board, a coating machine or an equivalent machine, in order to wind up the web without interrupting the production process, without shutting down the paper or board machine, successively onto a plurality of empty cores, which are also designated empty spools, or to wind up the web sporadically, following a break in the paper or board web or after starting up the paper or board machine, onto a preferably empty core.

In the process, care must be taken that the leading end of the web, produced by severing the web, is supplied to the preferably new core in order to form a preferably new roll on the core.

2. Discussion of Related Art

Methods of this type for transferring a moving web, in particular a paper or board web, onto a preferably new core are disclosed by the German patent applications DE 101 61 073.4 (PR11333 DE), DE 101 63 554.0 (PR11366 DE) and DE 102 01 410.8 (PR11328 DE) from the applicant, which are not prior publications.

In this case, at least one element in the form of an initial dividing piece is introduced between the web and a winding roll in such a way that a region of the initial dividing piece that is introduced is not covered by the web, in that, after reaching a nip formed by the winding roll and the core, the initial dividing piece is at least temporarily connected to the core in the uncovered region, and in that, at the latest at the point where the web runs off the core, severing of the web by the initial dividing piece is effected and/or made possible, by which a new leading end of the web, bonded to the initial dividing piece and the core, is formed.

SUMMARY OF THE INVENTION

Other exemplary embodiments and advantages of the present invention may be ascertained by reviewing the present disclosure.

The present invention provides an element and a method which permit improved formation of a leading end of a web from a moving web and, preferably, the transfer of the same onto a core with increased process reliability, improved handling and beneficial investment and process costs and which entirely avoid the disadvantages of the known prior art. Furthermore, the intention is for the method to be capable of application to the same extent as far as possible to all known types of reel-ups and a wide range of webs.

According to the invention, in an element for forming a leading end of a web from a moving web, in particular a paper or board web, having a certain width, this invention is achieved by the element having a smaller width than the width of the web and by the element being formed in such a way that, at the latest after its introduction into a nip formed by a winding roll and the core, a new leading end of the web is formed, and said element is at least partly covered by the web.

The smaller width of the element ensures that the element can be introduced at any point locally over the width of the web and, given good handling, in a reliable manner. Furthermore, on account of the formation of the element, it is ensured that, in general, the process reliability of the formation of a leading end of a web from a moving web and the desired transfer of the same is increased noticeably.

In this case, the term covering is to be understood to mean the moving web covering the element both on the underside and on the upper side.

With regard to further increased process reliability, it is advantageous if the element is formed in such a way that at least one connection is produced between the new leading end of the web and a core.

Both in the region not covered by the web and in the region covered by the web, the element has in each case at least one adhesive region, the process reliability already mentioned again being increased. Ideally, in this case the element has at least one dividing contour and/or a way for punching, cutting, perforating, embossing or weakening the web, at least in the region covered by the web, which substantially benefits the production of the new leading end of the web with regard to process reliability. In a particular embodiment, the dividing contour and/or modifier for punching, cutting, perforating, embossing or weakening is formed neither in the running direction nor transversely with respect to the running direction of the web.

With regard to the materials used in the machines mentioned above, it is advantageous if the element consists of a water-soluble material.

In order to keep the increase in diameter resulting from the introduction of the element as low as possible, the element has a thickness in the range from 0.05 mm to 1 mm, preferably in the range from 0.10 mm to 0.5 mm, in particular in the range from 0.10 mm to 0.25 mm.

From the point of view of improved handling with adequate process reliability, the element has a width of ≦1000 mm, preferably in the range from 100 mm to 500 mm, and a length of ≦1500 mm, preferably of ≦1000 mm.

Furthermore, the element is preferably formed as a molding made of a plastic, a textile material, a tear-resistant fibrous material, in particular paper, or of at least one material combination.

In a further refinement according to the invention, provision is made for the element to be formed as a composite object, comprising the element, at least one carrier and preferably at least one connector located in between them, and for preferably at least one element of the composite object to consist of water-soluble materials, preferably the element which is not wound into the roll after the severing of the web, and for the composite object and/or the carrier and/or and the connector to have an easily split structure.

This easily split structure provides the advantage that, following the severing of element and carrier, there are no longer any sticky surfaces and therefore the handling of the parts is benefited.

In another embodiment according to the invention, the connector has an easily split structure, the connector itself ideally consisting of at least one easily split medium.

The easily split medium is in turn water-soluble and advantageously comprises a paper carrier. Therefore, the easily split medium consists of the material of the product, which has advantages with regard to handling and the like arise, and the paper carrier satisfies the process engineering requirements, on account of the dimensioning.

In a further embodiment according to the invention, the connector comprises at least two elements connected by way of at least one form-fitting connection or a touch-and-close connection or a force-fitting connection. The elements themselves can in turn consist of a material that is similar to the product, preferably identical, and the connection can assume all known forms of easily split connecting technology, such as, for example, a tongue-and-groove connection as an example of a form-fitting connection.

The connector is preferably attached to the initial dividing piece and to the carrier by way of at least one adhesive layer in each case, the adhesive layer preferably being water-soluble and preferably having a layer thickness in the range from 25 μm to 100 μm, preferably in the range from 40 μm to 75 μm. In order to ensure improved handling, at least one of the adhesive layers has a covering. The covering is preferably provided with at least one slit for the purpose of improved detachment of the covering.

In the case of indirect introduction of the element, it is beneficial if it is provided by way of at least one adhesive area, by electrostatic forces, magnetic forces, application of a vacuum to the winding roll, at least one touch-and-close fastener or by way of at least one snap-fastener coupling in order to produce a temporary connection to the circumferential surface of the winding roll or the circumferential surface of the core.

With regard to the materials used in the machines mentioned at the beginning, it is advantageous if the element consists of at least one of water-soluble material.

In a first refinement, according to the invention, in a method for forming a leading end of a web from a moving web, in particular a paper or board web, the invention is achieved in that the leading end of the web is produced with at least one element according to the invention.

In a second refinement, according to the invention, in according to the invention, in a method for forming a leading end of a web from a moving web, in particular a paper or board web, onto a core, at least one element according to the invention being used, the invention is achieved in that the element is applied to the web in such a way that a region of the element applied is preferably not covered by the web, and in that, at the latest in the region of the point where the web runs off the core, severing of the web by the element is effected and/or made possible, by way of a new leading end of the web, bonded to the element and the core, is formed. In this case, after reaching a nip formed by a winding roll and the core, the element is preferably at least temporarily connected to the core in the preferably uncovered region.

As a result of the specific application of at least one element to the web which, after reaching the nip, is connected to the core in the region preferably uncovered by the web, and the defined severing of the web by the element, forming a new leading end of the web bonded to the element and the core, the known disadvantages of the prior art are entirely avoided.

In a further embodiment, after reaching a nip formed by the winding roll and the core, the element is at least temporarily connected to the core in the preferably uncovered region.

In another embodiment, the element is introduced substantially directly between the web and the winding roll by way of at least one dispensing device.

In yet another embodiment, in the case of a winding roll around which the web does not wrap, the element is introduced substantially directly into the nip by way of at least one dispensing device.

In another embodiment, the element is introduced indirectly between the web and the winding roll by way of at least one dispensing device.

In a further embodiment, the element is initially applied to the underside of the web and then, by way of the web, is introduced between the web and the winding roll.

In yet a further embodiment, the element is initially applied to the circumferential surface of the winding roll and then, by way of the winding roll, is introduced between the web and the winding roll.

In another embodiment, the element is introduced substantially directly between the web and the core by way of at least one dispensing device.

In a further embodiment, in the case of a core around which the web does not wrap, the element is introduced substantially directly into the nip by way of at least one dispensing device.

In yet a further embodiment, the element is introduced indirectly between the web and the core by way of at least one dispensing device.

In another embodiment, the element is initially applied to the upper side of the web and then, by way of the web, is introduced between the web and the core.

In yet another embodiment, the element is initially applied to the circumferential surface of the core and then, by way of the core, is introduced between the web and the core.

In a further embodiment, after leaving the nip, the carrier is carried along neither with the new leading end of the web nor with the core.

In yet a further embodiment, after leaving the nip, the carrier is caught by at least one catching device.

In another embodiment, the last device and/or the last element, as viewed in the running direction of the web, for severing and/or for transferring the web to a core is formed by the element.

In particular, by way of the defined and reliable formation of a new, bonded leading end of the web, an absolutely clean winding start is ensured, which represents one of the most important preconditions for an optimal winding structure and a small amount of broke. At the same time, using the method comprising only a few method steps, the greatest reproducibility and therefore associated reliability is achieved when transferring moving webs, with extremely beneficial investment and method costs.

According to the invention, the element can be introduced in many kinds of ways by way of at least one dispensing device.

In principle, an introduction to the underside of the web can be carried out as follows:

- substantially directly between the web and the winding roll;
- in the case of a winding roll around which the web does not wrap, substantially directly into the nip;
- indirectly between the web and the winding roll;
- initially to the underside of the web and then, by way of the web, between the web and the winding roll; and
- initially with a temporary connection to the circumferential surface of the winding roll and then, by way of the winding roll, between the web and the winding roll.

In principle, an introduction to the upper side of the web can be carried out as follows:

substantially directly between the web and the core;

in the case of a core around which the web does not wrap, substantially directly into the nip;

indirectly between the web and the core;

to the upper side of the web and then, by way of the web, between the web and the core; and initially with a temporary connection to the circumferential surface of the core and then, by way of the core, between the web and the core.

In order that the winding quality of the core is not impaired in a lasting manner, after leaving the nip, the carrier is preferably carried along neither with the new leading end of the web nor with the core. In a preferred embodiment, after leaving the nip, the carrier is caught by way of at least one catching device.

With regard to process reliability and optimization, it is advantageous if, according to the invention, the last device and/or the last element—as viewed in the running direction of the web—for severing and/or for transferring the web to a core is formed by the element.

It goes without saying that the features of the invention mentioned above and still to be explained below can be used not only in the respectively specified combination but also in other combinations or on their own without departing from the scope of the invention.

Further features and advantages of the invention emerge from the subclaims and the following description of preferred exemplary embodiments, with reference to the drawings.

BRIEF DESCRIPTION OF THE DRAWINGS

The present invention will be described in the following text by the exemplary, non-limiting embodiments shown in the figures, wherein:

FIG. 4(*a*) shows a first schematized sectional illustration of an element according to the invention in the configuration as a composite object;

FIG. 4(*b*) shows an enlarged view of a portion of the composite object;

FIG. 5 shows a second schematized sectional illustration of the element according to the invention in the configuration as a composite object during a transfer operation.

DETAILED DESCRIPTION OF THE INVENTION

The following preferred specific embodiments are, therefore, to be construed as merely illustrative, and not limitative of the remainder of the disclosure in any way whatsoever.

Figure 1:
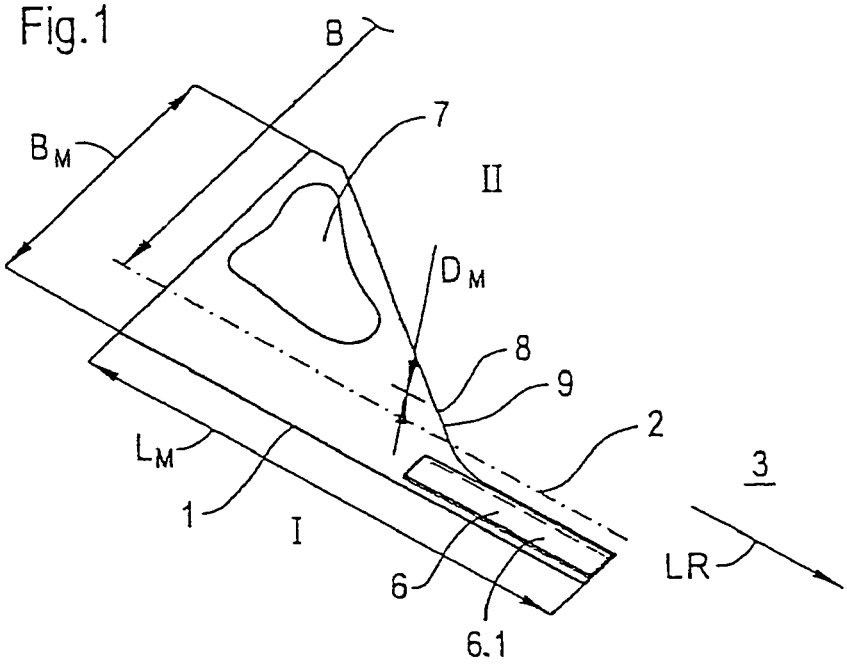
FIGS. 1 to 3 show schematized and perspective illustrations of possible embodiments of the element according to the invention.

FIG. 1 shows a first schematized and perspective illustration of an element 1 according to the invention for transferring a moving web 2, in particular a paper or board web, having a width B, onto a core 3 (not shown).

Figure 6:
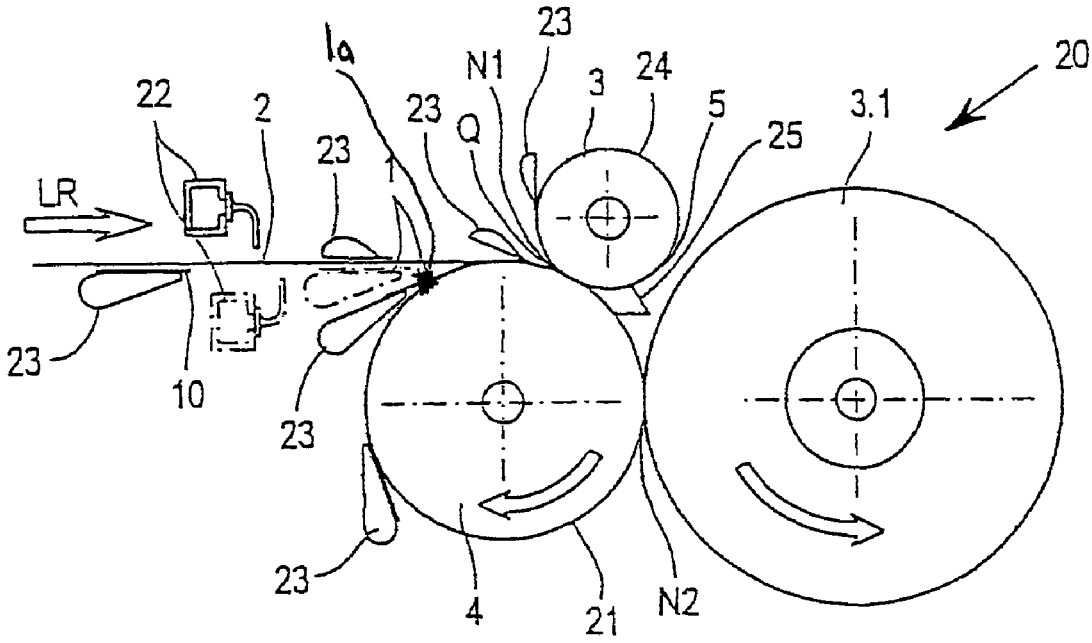
FIG. 6 shows an embodiment of a known winder in a schematized side view.

According to the invention, provision is now made for the element 1 to have a smaller width $B_M$ than the width B of the web 2, and for the element 1 to be formed in such a way that, following its introduction into a nip N1 formed by a winding roll 4 and the core 3 (not shown) a new leading end of the web is formed, the element 1 being at least partly covered by the web 2. Here, preferably at least one connection is produced between the new leading end of the web (not shown) and the core 3 (not shown) (FIG. 6).

Since the preferred embodiment of the invention of element 1 consists, inter alia, in the formation of a new leading end of a web (not shown), the element 1 has at least one dividing contour 8, for example in the form of an edge, at least in the region 11 covered by the web 2. Alternatively or in addition to the dividing contour 8, the element 1 can have at least one modifier 9 for punching, cutting, perforating, embossing or weakening the web 2 in the region covered by the web 2. In this case, the dividing contour 8 and/or the modifier 9 are formed neither in the running direction LR (arrow) nor transversely with respect to the running direction LR (arrow) of the web 2. A new leading end of a web, not illustrated, bonded to the element 1 and the core 3 (not shown) can be formed, for example, by the strip enclosed between the core 3 (not shown) and the element 1 being substantially completely severed by the element 1 by tearing along the dividing contour 8. In order to make the tearing progressive and, as a result, reliable, the corresponding edge can be formed at an angle matched to the tearing behavior of the web 2. Because of the method, the new leading end of the web, not illustrated, is enclosed between the core 3, not illustrated, and the element 1 and is therefore already bonded to these. In order to improve the bonding of the new leading end of the web (not shown) to the element 1, the latter can additionally be provided with, for example, an adhesive region 7, which can also be used for the indirect introduction of the element 1 between the strip and the winding roll 4 by way of a dispensing device.

Furthermore, the element 1 has a thickness $D_M$ in the range from 0.05 mm to 1 mm, preferably in the range from 0.10 mm to 0.5 mm, in particular in the range from 0.10 mm to 0.25 mm, a width $B_M$ of $\leqq$1000 mm, preferably in the range from 100 mm to 500 mm, and a length $L_M$ of $\leqq$1500 mm, preferably of $\leqq$1000 mm.

The element 1 is preferably formed as a molding made of a plastic, a textile material, a tear-resistant fibrous material, in particular paper, or of at least one material combination, and consists of at least one water-soluble material.

Furthermore, the element 1 has at least one adhesive region 6, 7 in each case both in the region I not covered by the web 2 and in the region 11 covered by the web 2 (division by way of a dashed line). Since the production of a connection between the element 1 and the new core 3 (not shown) belongs to a preferred method step, the element 1 for producing this connection is provided in the adhesive region 6 with adhesive 6.1, it being possible for these adhesive 6.1 to extend over a part, a number of parts or all of the element 1. Solely in the case of a adhesive 6.1 in the form of adhesives is a virtually unlimited range with which such a connection can be produced. From the point of view of reusing the cores, very good results are achieved in particular with removable adhesive, similar to Tesa Powerstrip® from Beiersdorf. The use of hot-melts, which have neutral adhesive properties at ambient temperature and become capable of producing a connection only after reaching a specific temperature, is of great interest, not just in view of automated handling and supply of the elements to the dispensing device. For example, an element laminated with hot-melt, similar to the single-sheet feed of a commercially available printer, can be supplied simply and reliably from a storage cartridge to the actual dispensing device, and the desired adhesive properties can be activated at a later time by supplying heat. In this way, given a suitable, reactive hot-melt, even an only temporary connection, existing at least for the duration of an initial revolution, can be produced between the element and the core. Comparable advantages can be achieved by the use of encapsulated adhesives, which are activated only by the exertion of a specific pressure. The enumeration of all types of connections which are suitable with a detailed description of the advantages resulting therefrom is not critical to this invention and would certainly go beyond the bounds of this document. For this reason, reference will be made only generally to the fact that this connection can also be configured as a form-fitting connection, in particular a touch-and-close connection, and as a welded connection, in particular a thermal welded connection, or as a magnetic connection, in order that the element is at least temporarily connected to the core in the uncovered region and fulfills its tasks.

Figure 2:
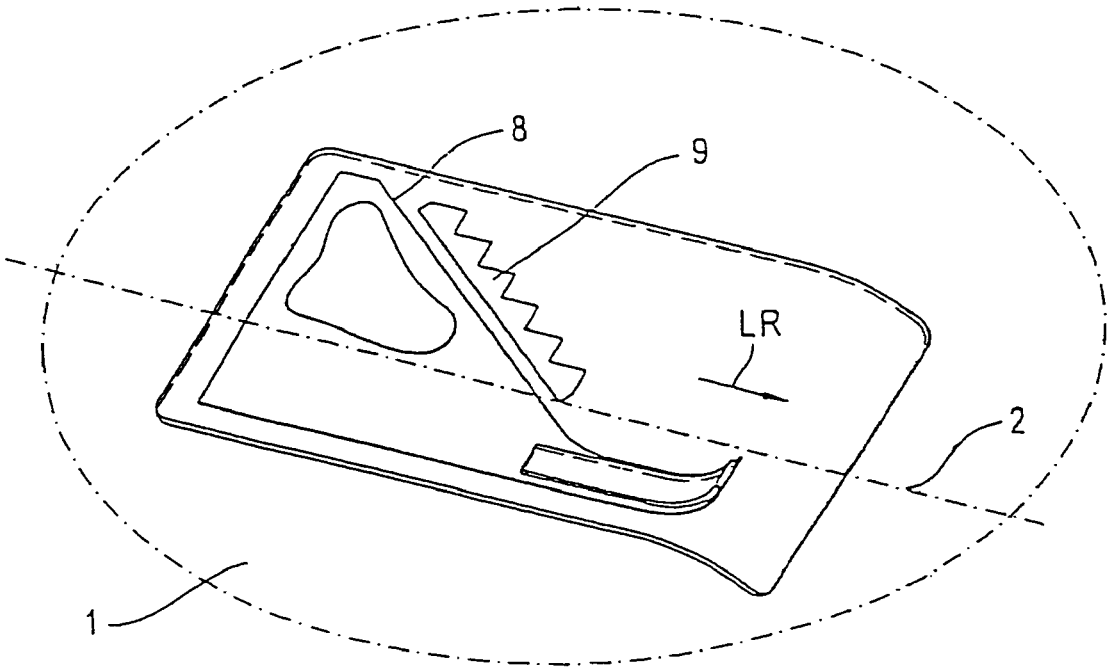

FIG. 2 shows a further embodiment of the element 1 according to the invention. In this case, the element 1 is applied in a manner according to the invention to a carrier 10, the element 1 having at least one dividing contour 8 in the region covered by the web 2 (dashed outline). For some applications, in particular transferring webs with a high tearing strength, the element has at least one modifier 9 for punching, cutting, perforating, embossing or weakening the web in the region covered by the web 2 (dashed outline). The modifier 9 preferably acts with the aid of the forces prevailing in the nip or by way of at least one auxiliary device, not illustrated, additionally arranged upstream of the nip. In the case of transferring webs which have a defined melting point behavior, such as plastic webs, the heat for severing the strip (transfer strip) can also be used by the element being equipped with an electric resistance wire as a severing means. The energy needed to produce the heat can be transferred without contact, for example in an inductive manner, preferably immediately upstream of the nip, by way of a known device (not shown).

Both the dividing contour 8 and/or the modifier 9 are formed neither in the running direction LR (arrow) nor transversely with respect to the running direction LR (arrow) of the web 2 (dashed outline).

Figure 3:
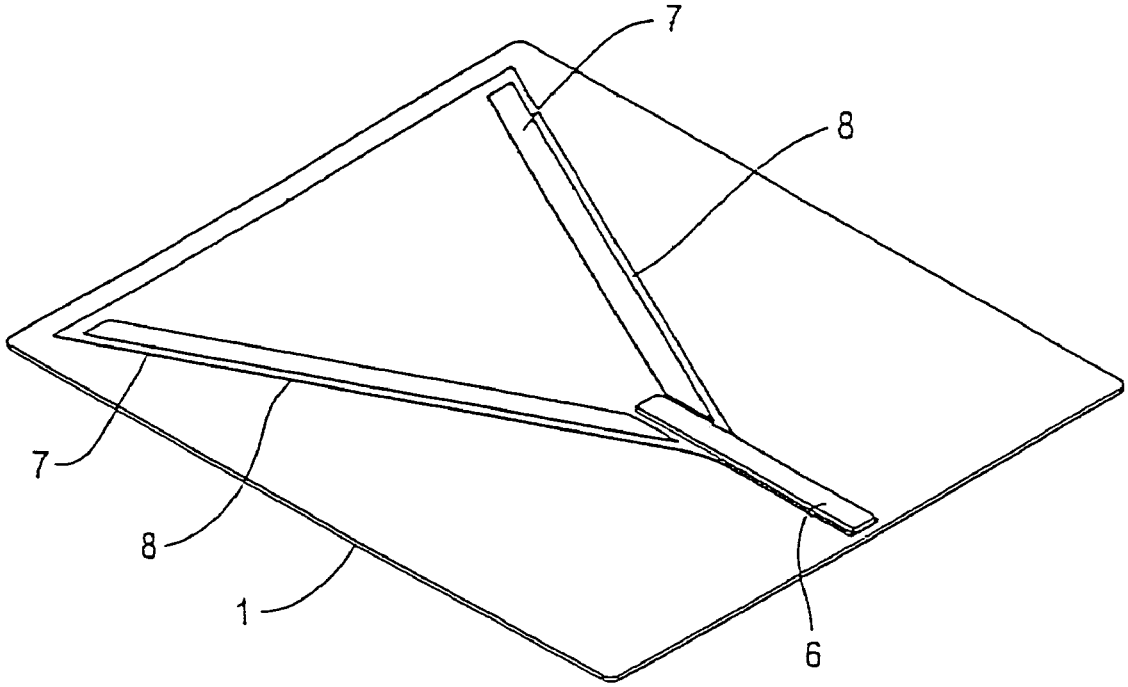

FIG. 3 also shows a further embodiment of the element 1 according to the invention.

According to the invention, because of the position of the adhesive regions 6, 7 and the possible dividing contour 8, this element 1 is suitable in particular for transferring the web (not shown) to a new core while producing an introduction area together with strip (transfer strip) in the center or in the central region of the web.

FIG. 4 shows a first schematized sectional illustration of an element according to the invention in the form of a composite object 11 for transferring a moving web 2, in particular a paper or board web, onto a core (not shown).

The composite object 11 according to the invention comprises an element 1, at least one carrier 10 and preferably at least one connector 12 located in between them. The connector 12 has an easily split structure 13 and, in the preferred way, consists of at least one easily split medium 13, which is preferably water-soluble and consists of a paper carrier 15.

Alternatively, the connector 12 can also comprise at least two elements connected by of at least one form-fitting connection or a touch-and-close connection or a force-fitting connection.

Furthermore, the connector 12 is attached to the element 1 and to the carrier 10 by way of at least one adhesive layer 16, 17 in each case. Here, the respective adhesive layer 16, 17 does not have to be applied over the area; a respective application, for example in the form of segments and the like, is sufficient to satisfy the respective requirements. The adhesive layers 16, 17 are preferably water-soluble and have a respective layer thickness $D_{16}$, $D_{17}$ in the range from 25 μm to 100 μm, preferably in the range from 40 μm to 75 μm.

In a further refinement, at least one of the adhesive layers 16, 17 has a covering 18 before the element 1 and/or the carrier 10 is attached, the covering 18 preferably being provided with at least one slit 19.

FIG. 5 shows a second schematized sectional illustration of the element 1 according to the invention in the form of a composite object 11 during a transfer operation. With regard to the description of the general structure, reference is made to the description of FIG. 4.

It can be seen clearly that the connector 12 has an easily split structure 13. In this case, the connector 12 preferably consists of at least one easily split medium 14, which preferably consists of a paper carrier 15.

The easily split paper carrier 15 is split at least into the two paper carrier parts 15.1, 15.2 because of the forces acting during the transfer operation together with the force directions (arrows), there being no adhesive areas after the splitting.

The paper carrier part 15.1 remaining on the surface of the winding roll (not shown) is preferably detached from the same immediately after the splitting of the paper carrier 15, by way of a scraper system known to those skilled in the art.

As already explained, the connector 12 can alternatively also comprise at least two elements connected by way of at least one form-fitting connection or a touch-and-close connection or a force-fitting connection.

FIG. 6 shows an embodiment of a known winder 20 in a schematized side view. A winder 20 of this type is sufficiently well known from the published PCT specification WO 98/52858 A1 (≡EP 0 912 435 A1; U.S. Pat. No. 6,129,305 A) or the further specifications EP 0 543 788 A1, DE 35 15 519 C2 or U.S. Pat. No. 4,445,646 A; the content of these specifications are incorporated herein by reference in their entirety.

The winder 20 comprises, inter alia, a winding roll 4 also designated a pressure drum or carrier drum. The web 2 is either led out of a smoothing unit/calendar (not shown) a final group of a converting machine or a drying section (not shown) of a paper or board machine, then normally wrapped around a guide or spreader roll (not shown) and then runs in the running direction LR (arrow) on the circumferential surface 21 of the winding roll 4, wraps around the circumferential surface 21 of the winding roll 4 by a certain angle ("wrap angle") as far as the nip N2 between the winding roll 4 and a roll 3.1 and is finally wound onto the roll 3.1. Then, if the roll 3.1 has reached a predetermined diameter, a core 3, preferably an empty spool, is accelerated forward by way of a drive device (not shown) and brought into contact with the winding roll 4, forming a nip N1. After that, at least one division is normally made in the moving web 2, before or on the winding roll 4, in at least one edge region by way of at least one known severing device 22, wherein at least one strip (transfer strip) is formed. In order to transfer the entire web 2 onto the core 3, the strip is severed and transferred to the new core 3.

According to the method of the invention, in a first embodiment provision is made for the leading end of the web to be produced with at least one element 1 according to the invention.

In a second embodiment of the method according to the invention, provision is made for the element 1 to be applied to the web 2 in such a way that a region of the element 1 applied is preferably not covered by the web 2 and, at the latest in the region of the point Q where the web 2 runs off the core 3, severing of the web 2 by the element 1 is effected and/or made possible, by way of a new leading end of the web, bonded to the element 1 and the core 3, is formed. In the process, after reaching a nip N1 formed by the winding roll 4 and the core 3, that the element 1 is at least temporarily connected to the core 3 in the preferably uncovered region I.

According to the invention, the element 1 can be introduced in many kinds of ways by at least one dispensing device 23. A few possibilities are shown in FIG. 6 for the purpose of better understanding.

According to the invention, the introduction of the element 1 to the underside of the web 2 can in principle be carried out as follows:

- substantially directly between the web 2 and the winding roll 4;
- in the case of a winding roll 4 around which the web 2 does not wrap, substantially directly into the nip N1;
- indirectly between the web 2 and the winding roll 4;
- initially to the underside of the web 2 and then, by way of the web 2, between the web 2 and the winding roll 4; and
- initially with a temporary connection to the circumferential surface 21 of the winding roll 4 and then, by way of the winding roll 4, between the web 2 and the winding roll 4.

According to the invention, the introduction of the element 1 to the upper side of the web 2 can in principle be carried out as follows:

- substantially directly between the web 2 and the core 3;
- in the case of a core 3 around which the web 2 does not wrap, substantially directly into the nip N1;
- indirectly between the web 2 and the core 3;
- to the upper side of the web 2 and then, by way of the web 2, between the web 2 and the core 3; and
- initially with a temporary connection to the circumferential surface 24 of the core 3 and then, by way of the core 3, between the web 2 and the core 3.

In order to produce a temporary connection to the circumferential surface 21 of the winding roll 4 or the circumferential surface 24 of the core 3, the element 1 is provided by way of at least one adhesive area, by way of electrostatic forces, by way of magnetic forces, by way of the application of a vacuum to the winding roll 4, by way of at least one touch-and-close fastener or by way of at least one snap-fastener coupling, all of which are schematically represented at reference numeral 1*a*.

Furthermore, the invention provides for the carrier 10, after leaving the nip N1, to be carried along neither with the new leading end of the web nor with the core 3. After leaving the nip N1, the carrier 10 is preferably caught by way of at least one catching device 25 and removed from the region of the winder 20 by way of various possibilities. The catching apparatus 25 is merely illustrated schematically in FIG. 6; however, in principle, it can assume all known embodiments (catching funnel, with/without applied vacuum, etc.).

Should the carrier 10 remain on the surface of the winding roll 4, then, immediately after its division from the element, it is preferably detached from the surface of the winding roll 4 by way of a scraper system known to those skilled in the art and preferably caught by way of at least one catching apparatus 25 and removed from the region of the winder 20 by way of various possibilities.

In principle, provision is made for the last device and/or the last element—as viewed in the running direction LR (arrow) of the web 2—for severing and/or for transferring the web 2 onto a core 3 to be formed by the element 1.

According to the prior art, the severing device 22 can be arranged on the upper side or underside of the web 2, upstream of the nip N1, and can have at least one cutting element, preferably a cutting element having a jet or beam with a high energy density, in particular a water-jet or laser-beam cutting element. Since no unambiguously preferred arrangement of the severing device 22 exists, the result, as can be seen clearly from FIG. 6, is a quite large number of possible combinations in the arrangement of the dispensing device 23 and of the severing device 22 with the winder 20.

In summary, it is to be recorded that, by the invention, a composite object and a method of the type respectively mentioned above are provided, which permit improved transfer of a moving web onto a new core with increased process reliability, better handling and beneficial investment and method costs, and which entirely avoid the disadvantages of the known prior art. Furthermore, the method can be used to the same extent for all known types of reel-ups and a wide range of webs.

LIST OF DESIGNATIONS

| | |
|---|---|
| 1 | Element |
| 2 | Web |
| 3 | Core |
| 3.1 | Roll |
| 4 | Winding roll |
| 5 | Leading end of a web |
| 6, 7 | Adhesive region |
| 6.1 | Adhesive |
| 8 | Dividing contour |
| 9 | Modifyer |
| 10 | Carrier |
| 11 | Composite object |
| 12 | Connector |
| 13 | Easily split structure |
| 14 | Easily split medium |
| 15 | Paper carrier |
| 15.1, 15.2 | Paper carrier part |
| 16, 17 | Adhesive layer |
| 18 | Covering |
| 19 | Slit |
| 20 | Winder |
| 21 | Circumferential surface (winding roll) |
| 22 | Severing device |
| 23 | Dispensing device |
| 24 | Circumferential surface (core) |
| 25 | Catching device |
| B | Width |
| $B_M$ | Width (element) |
| $D_{16}$, $D_{17}$ | Layer thickness |
| $D_M$ | Thickness (element) |
| I | Uncovered region |
| II | Covered region |
| $L_M$ | Length (element) |
| LR | Running direction (arrow) |
| N1 | Nip (winding roll-core) |
| N2 | Nip (winding roll-roll) |
| Q | Run-off point (web) |

What is claimed is:

1. An element in combination with a web, the element being only one element for forming a leading end of the web from a moving web which has a width (B), wherein the only one element has a width ($B_M$) transverse to the running direction smaller than the width (B) of the web and wherein the element is formed such that, at the latest after the introduction of the only one element into a nip formed by a winding roll and a core, the only one element severs the web and a new leading end of the web is formed, and the only one element is at least partly covered by the web.

2. The element as claimed in claim 1, wherein the element is formed in such a way that at least one connection is produced between the new leading end of the web and a core.

3. The element as claimed in claim 1, wherein the element has at least one adhesive region in a region not covered by the web.

4. The element as claimed in claim 1, wherein the element has at least one adhesive region in a region covered by the web.

5. The element as claimed in claim 1, wherein the element has at least one dividing contour, at least in a region covered by the web.

6. The element as claimed in claim 5, wherein the dividing contour has at least one modifier for punching, cutting, perforating, embossing or weakening the web in the region covered by the web.

7. The element as claimed in claim 6, wherein the modifier is formed neither in the running direction nor transversely with respect to the running direction of the web.

8. The element as claimed in claim 5, wherein the dividing contour is formed neither in the running direction nor transversely with respect to the running direction of the web.

9. The element as claimed in claim 1, wherein the element consists of a water-soluble material.

10. The element as claimed in claim 1, wherein the element has a thickness ($D_M$) in the range from 0.05 mm to 1 mm.

11. The element as claimed in claim 10, wherein the element thickness ($D_M$) is in the range from 0.10 mm to 0.5 mm.

12. The element as claimed in claim 10, wherein the element thickness ($D_M$) is in the range from 0.10 mm to 0.25 mm.

13. The element as claimed in claim 1, wherein the element has a width ($B_M$) of $\leqq$1000 mm.

14. The element as claimed in claim 13, wherein the element has a width ($B_M$) in the range of between 100 mm and 500 mm.

15. The element as claimed in claim 1, wherein the element has a length ($L_M$) of $\leqq$1500 mm.

16. The element as claimed in claim 15, wherein the element has a length ($L_M$) of $\leqq$1000 mm.

17. The element as claimed in claim 1, wherein the element is formed as a molding made of a plastic, a textile material, a tear-resistant fibrous material, or at least one combination thereof.

18. The element as claimed in claim 17 wherein the tear resistant fibrous material is paper.

19. The element as claimed in claim 1, wherein the element is formed as a composite object, comprising the element, and at least one carrier.

20. The element as claimed in claim 19, wherein at least one element of the composite object consists of water-soluble materials.

21. The element as claimed in claim 20, wherein the element is not wound into the roll after the severing of the web.

22. The element as claimed in claim 19, wherein the composite object is structured to be split.

23. The element as claimed in claim 19, wherein the carrier and/or the connector is structured to be split.

24. The element as claimed in claim 23, wherein the connector consists of at least medium which is structured to be split.

25. The element as claimed in claim 24, wherein the medium which is structured to be split is water-soluble.

26. The element as claimed in claim 25, wherein the medium which is structured to be split consists of a paper carrier.

27. The element as claimed in claim 19, wherein the connector comprises at least two elements connected by at least one form-fitting connection or a touch-and-close connection or a force-fitting connection.

28. The element as claimed in claim 19, wherein the connector is attached to the element and to the carrier by way of at least one adhesive layer in each case.

29. The element as claimed in claim 28, wherein the adhesive layer is water-soluble and has a layer thickness in the range from 25 μm to 100 μm.

30. The element as claimed in claim 29, wherein the adhesive layer has a layer thickness in the range from 40 μm to 75 μm.

31. The element as claimed in claim 28, wherein at least one of the adhesive layers has a covering.

32. The element as claimed in claim 31, wherein the covering is provided with at least one slit.

33. The element as claimed in claim 1, wherein the element is provided with at least one adhesive area, by way of electrostatic forces, magnetic forces, application of a vacuum to the winding roll, by at least one touch-and-close fastener or by way of at least one snap-fastener coupling thereby forming a temporary connection to the circumferential surface of the winding roll.

34. The element as claimed in claim 1, wherein the element consists of at least one water-soluble material.

35. The element as claimed in claim 1, wherein the moving web is a paper or board web.

36. The element as claimed in claim 1, wherein the element is formed as a composite object, comprising the element, at least a cone carrier, and at least one connector located in between them.

37. An element in combination with a web for forming a leading end of a web from a moving web, the element being only one element and comprising at least one water-soluble material, the only one element further comprising at least one adhesive region and a dividing contour, the only one element having a width ($B_M$) transverse to the running direction of smaller than the width of the web $\leqq$1000 mm, a length ($L_M$) of $\leqq$1500 mm and a thickness ($D_M$) in a range from 0.05 mm to 1 mm, wherein the only one element is formed such that, at the latest after the introduction of the element into a nip formed by a winding roll and a core, the only one element severs the web and a new leading end of the web is formed.

* * * * *